US005167106A

United States Patent [19]

Ohno

[11] Patent Number: 5,167,106

[45] Date of Patent: Dec. 1, 1992

[54] FIXING STRUCTURE OF WALL MATERIALS

[75] Inventor: Kaisaku Ohno, Tokyo, Japan

[73] Assignee: Kabushiki Kaisha Opelook, Tokyo, Japan

[21] Appl. No.: 569,414

[22] Filed: Aug. 17, 1990

[30] Foreign Application Priority Data

Mar. 31, 1990 [JP] Japan ..... 2-35140[U]

[51] Int. Cl.[5] ..... E04B 1/38

[52] U.S. Cl. ..... 52/513; 52/510; 52/379

[58] Field of Search ..... 52/513, 562, 563, 564, 52/379, 566, 510, 384, 386

[56] References Cited

U.S. PATENT DOCUMENTS

| | | | |
|---|---|---|---|
| 3,350,830 | 10/1967 | Smith, Jr. et al. | 52/379 X |
| 3,559,358 | 2/1971 | Lohse et al. | 52/513 X |
| 3,813,838 | 6/1974 | Brown et al. | 52/510 X |
| 4,262,464 | 4/1981 | Ludowici | 52/510 |

*Primary Examiner*—David A. Scherbel
*Assistant Examiner*—Joanne C. Downs
*Attorney, Agent, or Firm*—Gifford, Groh, Sprinkle, Patmore and Anderson

[57] ABSTRACT

This invention is a structure enabling materials having a dense, stone-like composition to be more easily affixed to wall surfaces. The structure includes a flat plate attached to a wall surface and a backplate attached to the material, the two being connected by fitting hardware.

5 Claims, 5 Drawing Sheets

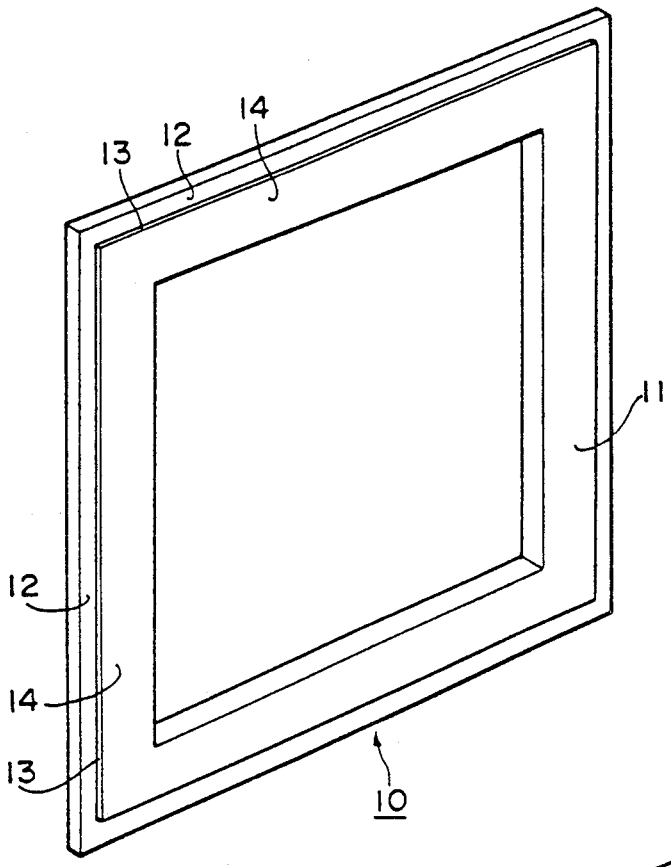
Fig. 3
Fig. 4
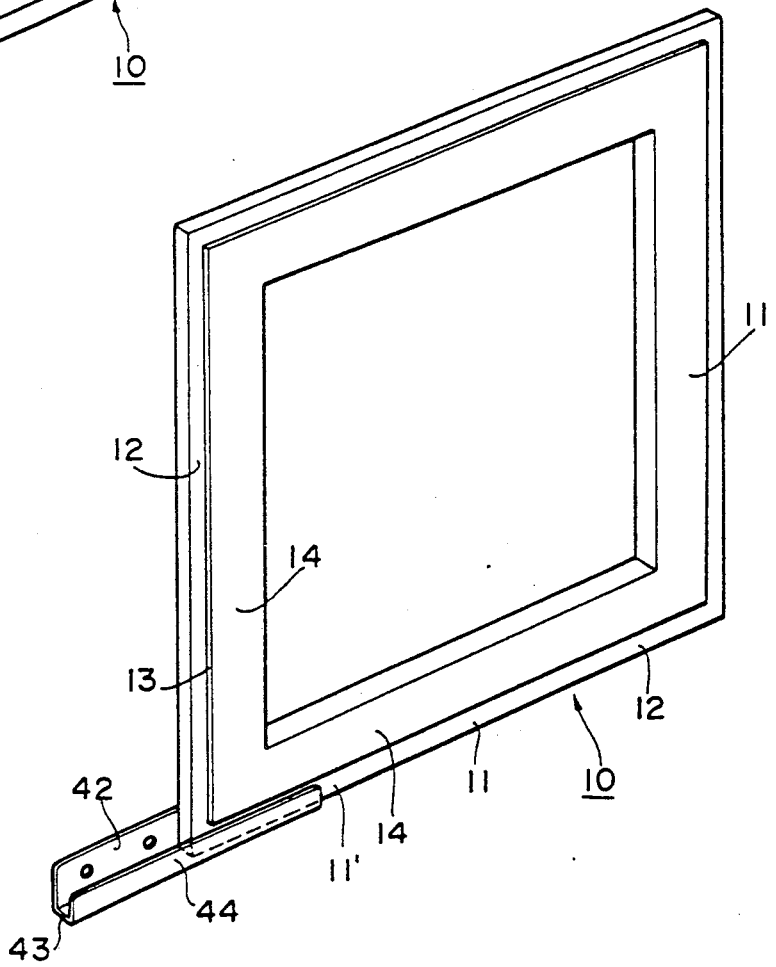

FIXING STRUCTURE OF WALL MATERIALS

BACKGROUND OF THE INVENTION

I. Field of the Invention

This invention relates to a fixing structure to fix wall materials such as marble, granite, slate, stone, artificial stone, tile and ceramic plate to a wall surface.

II. Description of the Prior Art

Conventionally, to fix wall materials such as marble, granite, slate, stone, artificial stone, tile and ceramic plate to a wall surface, as shown in FIG. 17, cement mortar 2 was applied to the wall surface 1, where the wall material 3 having transversal grooves 3*a* at its backside was pressed against the cement mortar 2. The cement mortar 2 was forced to enter into the grooves 3*a* which increased the fixing strength of the wall material to a wall surface.

PROBLEM WHICH THIS INVENTION INTENDS TO SOLVE

However, this conventional fixing structure has several problems, which are as follows:

(a) It takes a long time to work as the wall material 3 is not fixed until the cement mortar 2 dries.

(b) Skill is required to use the conventional fixing structure.

Heavy stones such as marble and granite may become detached because of the lack of fixing strength.

An object of the present invention is to provide a fixing structure for wall materials to eliminate the above-mentioned disadvantages.

MEANS TO SOLVE AFOREMENTIONED PROBLEMS

To eliminate the aforementioned problems, the fixing structure of the present invention has characteristics comprising:

a fitting hardware consisting of a flat plate fastened to the wall, a rising portion having predetermined height extending from the flat plate and an inserting portion extending from the top of the rising portion;

a backplate fastened to the backside of the wall materials having a step portion at its edge portion for the backside end portion of the wall materials; and wall material fastened to the wall as follows; the fitting hardware is fastened to the wall surface by the flat plate, the backplate is fastened to the backside of the wall material, the inserting portion of the fitting hardware is inserted within a clearance formed between the edges of the fixed wall materials and the backplate.

Using the construction as described above, the wall material is fixed to the wall by fastening the fitting hardware to the wall and then interplacing the inserting portion of the fitting hardware within a clearance between the edge surface of the wall material and the backplate.

BRIEF DESCRIPTION OF THE DRAWINGS

The invention is illustrated diagrammatically in the following drawings, wherein:

FIG. 3 is a perspective view thereof taken from the splicing side;

FIG. 4 is a perspective view thereof with the fitting hardware mounted thereto;

DETAILED DESCRIPTION OF THE INVENTION AND PREFERRED EMBODIMENT THEREOF

Figure 1:
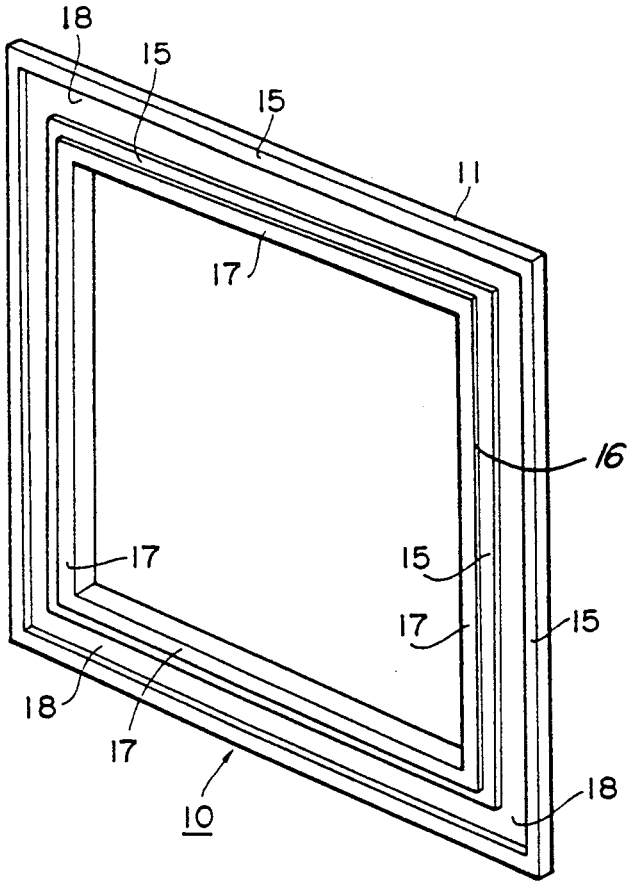
FIG. 1 is a perspective view of the backplate of the present invention, taken from the wall side.

A preferred embodiment of the present invention will be explained with reference to the drawings.

FIGS. 1 through 4 show a backplate 10, which is cemented to the backside of the wall material, and is formed from plastic molding or pressed metal plate for example.

The backplate 10 has, for example, a rectangular frame portion 11, and as shown in FIGS. 3 and 4, the front side (the side opposing to the wall) of the frame portion 11 has a splicing surface 14 heightened one step higher than a frame surface 12 by a step portion 13.

Figure 2:
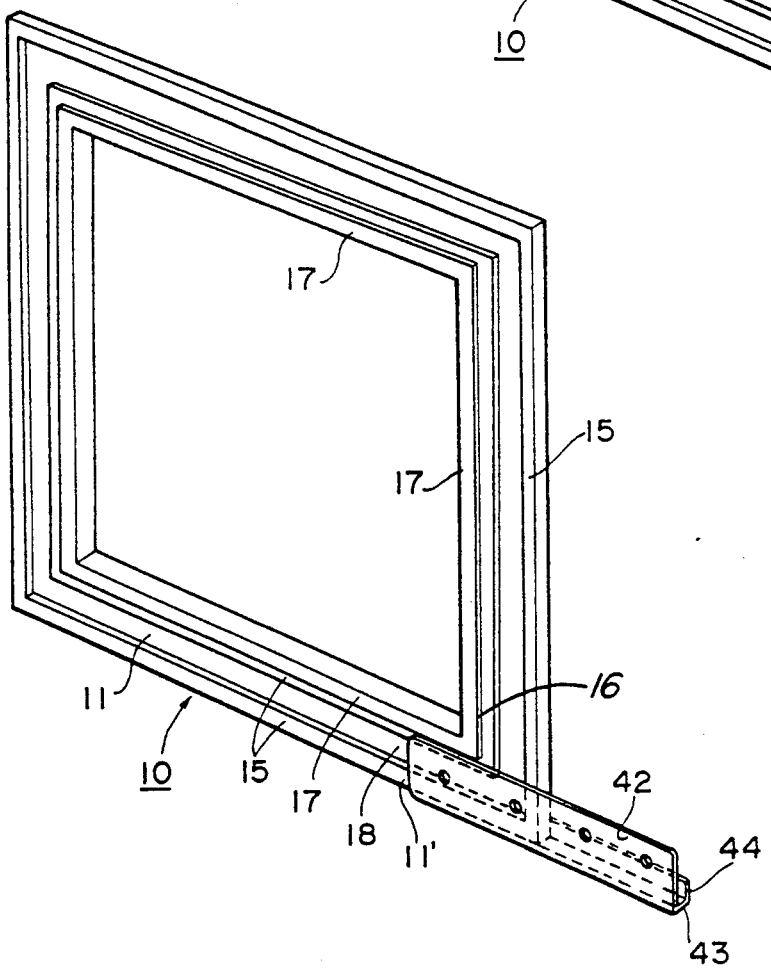
FIG. 2 is a perspective view of the backplate with a fitting hardware mounted thereto.
Figure 5:
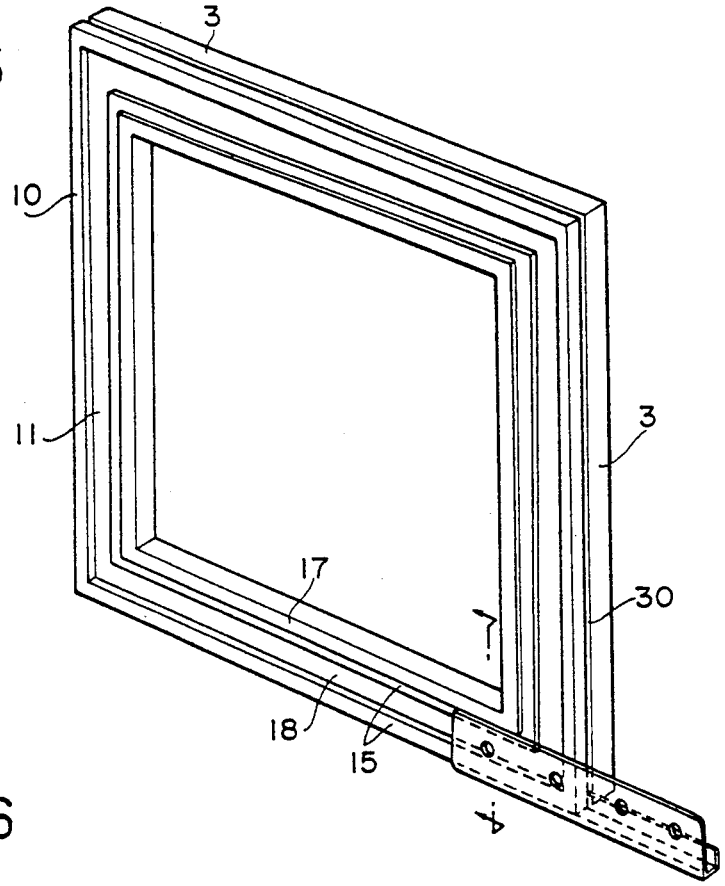
FIG. 5 is a perspective view showing a state in which the wall material and the backplate are fixed, including the fitting hardware mounted thereto.

The backside of the frame portion 11 has a wall abutting surface 17 heightened one step higher than a frame back surface 15 by a step portion 16, as shown in FIGS. 1 and 2. Further, the frame back surface 15 is provided with a recess portion 18.

Figure 12:
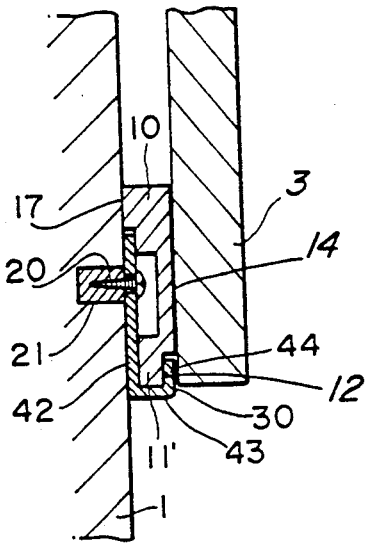
FIG. 12 is a sectional view showing an example of the fixing structure of the present invention.
Figure 13:
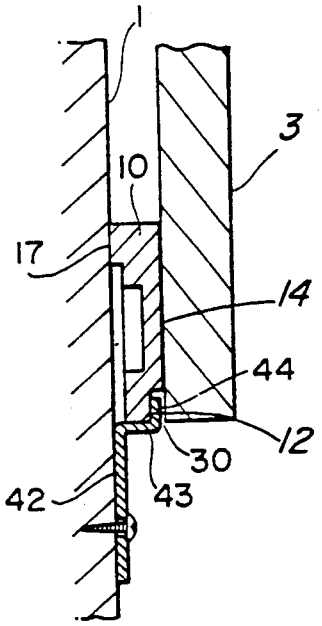
FIG. 13 is another sectional view thereof.

As shown in FIGS. 12 and 13, the splicing surface 14 of the frame portion 11 of this backplate 10 is fastened by adhesives to the backside of the wall materials as, for example, marble, granite, slate, artificial stone, tile and ceramic plate. The frame surface 12 of the frame portion 11 is lowered one step than the splicing surface 14, so that a clearance portion 30 is formed between the wall material 3 and the frame back surface (see FIGS. 12 and 13).

Figure 6:
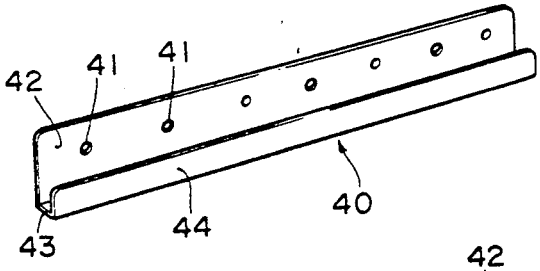
FIGS. 6 through 10 are perspective views of the preferred embodiments of the fitting hardware of the present invention.
Figure 7:
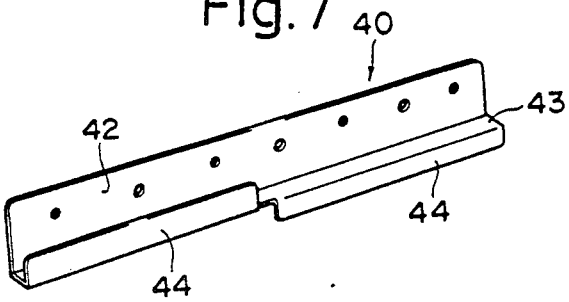
Figure 8:
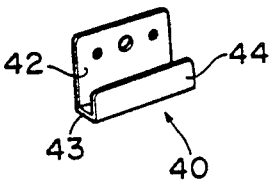

FIG. 6 shows an example of a fitting hardware 40. This fitting hardware 40 is provided with a flat plate portion 42 having mounting holes 41 to fasten to the wall by, screws or nails and the like, a rising portion 43 extending from the flat plate portion 42, and an inserting portion 44 extending parallel to the flat plate portion 42 from the top of the rising portion 43.

The rising portion 43 has a heigh where the edge portion 11' of the frame portion 11 of the backplate 10 is able to engage (see FIG. 12), and, as shown in FIG. 2, when it is in engaged condition with the edge portion 11', the flat plate portion 42 is approximately flush with or is lowered slightly than a wall abutting surface 17 of the wall surface side of the frame portion, and, as shown in FIG. 4, the insert portion 44 is flush with or is lowered slightly than the contact surface 14 of the frame portion 11.

Figure 11:
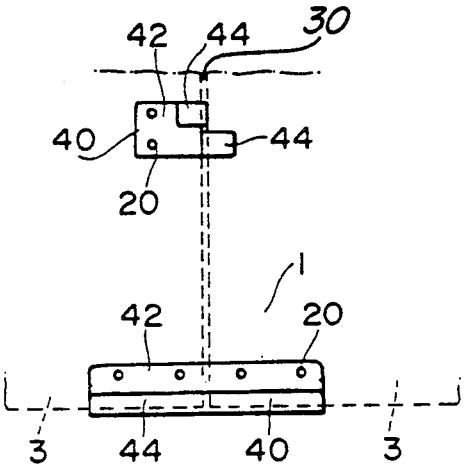
FIG. 11 is a front elevation view showing an example in the state the fitting hardware is fixed to the wall.

For example, the flat plate portion 42 of the fitting hardware 40, shown in FIG. 6, is fastened to the wall 1 in for example, a horizontal direction by screws, as shown in the lower part of the FIG. 11. That is, the wall 1 is of veneer base or of rafter and it can be fixed by screws or nails. In the case where the wall 1 is of concrete base, it can be fastened to the buried screw receiver parts 21 by screws 20, as shown in FIG. 12; and, in the case where the wall 1 is of steel frame or angled base, the flat plate 42 is fastened by bolting or other suitable manner instead of screws.

Figure 9:
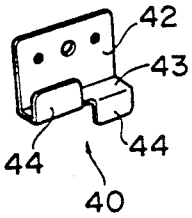
Figure 10:
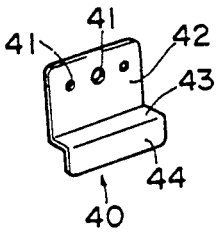

The fitting hardware 40 varies its form by the length or the bending direction of the inserting portion, as shown in FIGS. 6 through 10. For example, the fitting hardware 40 shown in FIG. 9 is fastened in a vertical direction, as shown in the upper part of FIG. 11.

Thus, the inserting portion 44 of the fitting hardware 40 is fastened on the wall 1 in a horizontal direction and is interposed within the clearance portion 30 between the lower edges of the backplate 10 and the wall material 3, as shown in FIG. 12. The inserting portion 44 of the fitting hardware 40 fastened in a vertical direction is interposed within the clearance portion 30 at the right side edge. In this manner, the wall material 3 is fixed to the wall by contacting the wall abutting surface 17 of the backplate 10 to the wall surface.

A large number of fitting hardware 40 are first fastened to the wall 1, and the wall materials 3 are fixed to the fitting hardware 40 in turn adjoining each other both upper and lower, right and left sides.

Between two adjacent wall materials 3 and 3, there is a clearance of the same dimension as the thickness of the rising portion 42 of the fitting hardware 40, where fillers like putty are added from the outside.

The fitting hardware 40 has some varieties, and they are properly used depending on the purposes. FIG. 13 is showing an example using the one illustrated in FIG. 10.

Figure 14:
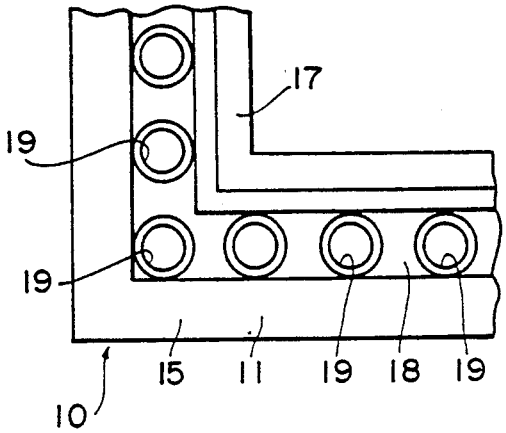
FIG. 14 is a partially enlarged plan view of another preferred embodiment of the backplate.
Figure 15:
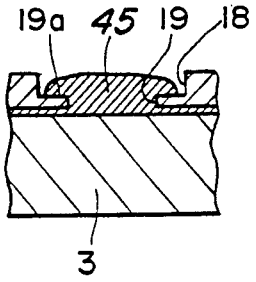
FIG. 15 is a sectional view showing a bonded condition of the backplate and the wall material of FIG. 14.

In addition, to further strengthen the adhesive fixation between the wall material 3 and the backplate 10, as shown in FIGS. 14 and 15, a large number of holes 19 are provided at a recess portion 18 of the frame portion 11, and, as shown in FIG. 15, an adhesive agent 45 is solidified in swelled condition spread at the surrounding of the circular step 19*a* of the hole 19, which leads to the hardness of the fixing condition.

Further, the adhesive force is also strengthened by providing grooves (not shown) on the splicing surface 14 whereby letting the adhesive agent in.

Figure 16:
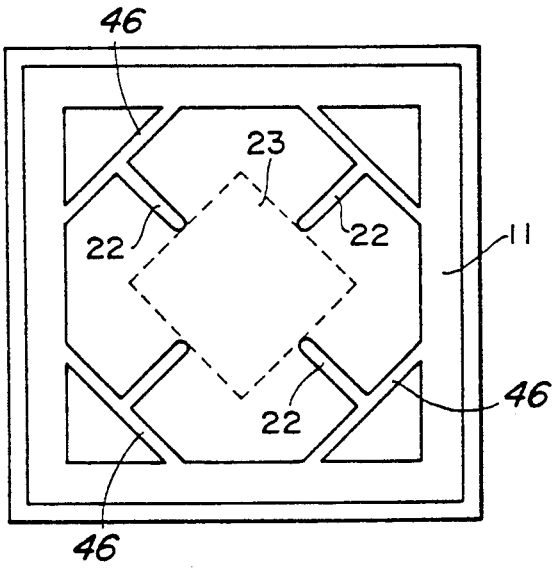
FIG. 16 is a plan view of another preferred embodiment of the backplate.
Figure 17:
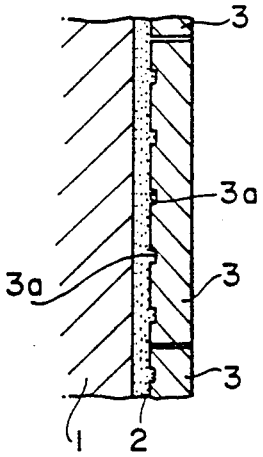
FIG. 17 is a sectional view of a conventional fixing structure.

In addition, as shown in FIG. 16, to strengthen the backplate 10, beams 46 and projections 22 may be extensively provided that are flush with the frame portion 11 at the inside thereof, and a plate shaped filler 23 for cushioning made of styrene foam or the like is placed within the projections 22, which may be placed between the wall 1 and the wall materials 3.

This explains a preferred embodiment of this invention; this is not limited in the structure described herein, and, as for the fixation means of a fitting hardware 40 to the wall 1, for example, it is possible to adapt an adhesion or other adequate means, and moreover, the shape of the backplate 10 may also be variable to anything that can be fixed to the wall materials 3 and insertingly fixed to the clearance portion 30 with the inserting portion 44 of the fitting hardware 40.

The backplate 10 may be fixed to the wall material 3 not necessarily by means of adhesion but also by other suitable fixing means.

The above describes the fixation of wall materials; it is obvious that this invention can be applied also to the fixation of floor materials.

EFFECT OF THE INVENTION

The fixing structure of the wall materials of this invention comprises: a fitting hardware which consists of a flat plate to fasten to the wall, a rising portion having predetermined height extending from the flat plate and an inserting portion extending from the top of the rising portion; and a backplate having a step portion at its edge to form a clearance to receive the inserting portion of the fitting hardware between the edge portions of the backplate and the wall materials, which is fixed to the backside of the wall material; the fitting hardware is fastened to the wall and the like by the flat plate, the backplate is fixed to the backside of the wall materials, and the inserting portion of the fitting hardware is interposed within the inserting clearance formed between the edge portions of the fixed wall material and the backplate; accordingly, this invention has these effects:

(a) A cement mortar as up until now used is unnecessary, and therefore a period for drying is not required, which leads to remarkable cost reduction both in construction and labor.

(b) Because the clearance portion 30 may only need to engage with the inserting portion 44 after the fitting hardware 40 is fastened, it is very simple and there is no need for skill, and linearity in the fixing of the wall material is easily gained by using a long sized fitting hardware 40.

(c) The fixing strength of this invention is greater than that of the conventional fixing construction by cement mortar shown as in FIG. 11.

(d) The strength of the whole part of the wall materials 3 is increased by fixing the backplate 10 at its backside. It is possible to make the wall materials 3 thin in a marked degree, which leads to the reduction of the cost and reduction of the weight of the wall materials 3, and also leads to a lessening of the distance between the wall 1 and the surface of the wall materials 3.

I claim:

1. A fixing structure for fixing a flat plate-shaped wall material to a wall, said wall material having a backside, said fixing structure comprising:

fitting hardware having a flat plate fastenable to said wall, a rising portion having a top, said rising portion extending normal to and having a predetermined height from said flat plate and an inserting portion extending from said top of said rising portion parallel to said flat plate; and a backplate to which said wall material is attachable, said backplate having a step portion provided at its edge portion to form an interposing clearance for said inserting portion of said fitting hardware between said step edge portion of said backplate and a backside edge portion of said wall material fastened to said backplate;

said flat plate of said fitting hardware is fastened to said wall, said backplate is fastened to said backside of said wall material, and said backplate is attached to said wall by inserting said inserting portion of said fitting hardware within said interposing clearance.

2. The fixing structure for wall materials according to claim 1, further characterized in that said flat plate has fixing holes, and is fixed to said wall by screws inserted through said fixing holes.

3. The fixing structure for wall material according to claim 1, further characterized in that said backplate has plural holes and is fastened to said wall material by an adhesive applied to said backside of said wall material, said adhesive extruding through said holes to an edge portion of said holes on a side of said backplate opposite to the side to which said wall material is attached.

4. A backplate to be fastened on a backside of wall material to fix plate shaped flat wall material to a wall surface comprising:

a step portion provided along the edge of said backplate to form an interposing clearance between said backplate and said wall material fixed thereto, said interposing clearance receiving therein a portion of a fitting hardware fixed on said wall surface.

5. The fixing structure to fix a plate-shaped wall material to a wall, said fixing structure comprising:

fitting hardware consisting of a flat plate to be fastened to said wall, a rising portion extending normal to said flat plate a predetermined height from an edge of said flat plate and an inserting portion extending from the top of said rising portion parallel to said flat plate;

a backplate having a step portion provided along its edge portions to form an interposing clearance between said edge portions and a backside of said wall materials fastened to said backplate;

said flat plate of said fitting hardware is fastenable to said wall, said backplate is fastened to the backside of said wall material, and said inserting portion of said fitting hardware is received within said interposing clearance formed between said step portions of said backplate and said wall material; and wherein said backplate is fastened to the backside of the wall material by an adhesive.

* * * * *

UNITED STATES PATENT AND TRADEMARK OFFICE

CERTIFICATE OF CORRECTION

PATENT NO. : 5,167,106

DATED : December 1, 1992

INVENTOR(S) : Kaisaku Ohno

It is certified that error appears in the above-identified patent and that said Letters Patent is hereby corrected as shown below:

Column 1, line 29, "Heavy stones" should read --(c) Heavy stones--

Column 1, line 45, after "for the" insert --fitting of hardware between the step portion and the--.

Signed and Sealed this

Nineteenth Day of October, 1993

Bruce Lehman

*Attest:*

BRUCE LEHMAN

*Attesting Officer*

*Commissioner of Patents and Trademarks*